US005168657A

United States Patent [19]

Yoshida

[11] Patent Number: 5,168,657

[45] Date of Patent: Dec. 8, 1992

[54] BOTTLE MOUTH TOP SURFACE POLISHING APPARATUS

[75] Inventor: Hajime Yoshida, Tokyo, Japan

[73] Assignee: Hajime Industries Ltd., Tokyo, Japan

[21] Appl. No.: 689,469

[22] Filed: Apr. 22, 1991

[30] Foreign Application Priority Data

Apr. 28, 1990 [JP] Japan ..... 2-113271
Apr. 28, 1990 [JP] Japan ..... 2-113272
Apr. 28, 1990 [JP] Japan ..... 2-113273

[51] Int. Cl.[5] ..... B24B 9/08

[52] U.S. Cl. ..... 51/109 R; 51/215 AR; 51/283 R; 51/326; 51/125

[58] Field of Search ..... 51/109 R, 125, 367, 51/382, 384, 24, 54, 128, 394, 376-379, 358, 170 T, 215 R, 215 AR, 215 E, 283 R, 326, 327, 3

[56] References Cited

U.S. PATENT DOCUMENTS 2,373,932 5/1945 Waters ..... 51/125
2,705,392 5/1955 Imler ..... 51/283
2,906,068 9/1959 Porter ..... 51/379
2,936,798 5/1960 Cummings ..... 53/281
3,889,428 6/1975 Steinegger ..... 51/215

*Primary Examiner*—Bruce M. Kisliuk
*Assistant Examiner*—Jack Lavinder
*Attorney, Agent, or Firm*—Bauer & Schaffer

[57] ABSTRACT

A bottle mouth top surface polishing apparatus including rotating machine having a rotary shaft, a rotary plate means coupled at its center to the rotary shaft, a grinding plate fixed to the rotary plate and having a grinding face which is to be made in contact with a bottle mouth top surface to be polished, and a contact adjusting device for making the contact between the grinding face and the bottle mouth top surface always close over whole contact surfaces thereof upon polishing.

6 Claims, 5 Drawing Sheets

BOTTLE MOUTH TOP SURFACE POLISHING APPARATUS

BACKGROUND OF THE INVENTION

1. Field of the Invention

The present invention relates generally to a bottle mouth polishing apparatus and more precisely, is directed to a bottle mouth top surface polishing apparatus that smoothens the top surface of bottle mouths for glass bottles or the like.

2. Description of the Prior Art

Glass bottles and so on that are formed by materials such as glass or the like are widely used as containers for liquors, pharmaceutical products and cosmetic products, etc., which are sealed by caps after being filled with the liquids. In this case, in order to secure a complete sealed condition to prevent liquid leakage, it is desirous that the glass bottle mouth top surface which contacts the inside surface of the cap, be a smooth flat plane so that the bottle mouth top surface and cap inside surface are in tight contact without interruptions throughout a wide area.

As one example in the case of a glass bottle, the finished condition of the top surface at the bottle mouth, which means that whether the top surface of the bottle mouth is finished to be a smooth flat surface or not becomes one important check point as a good bottle. Accordingly, at the inspection process for produced glass bottles, the finish condition of the top surface at the bottle mouth is an important inspection item which is checked by visual inspection or by machine vision which combines image sensers such as television cameras with an electronic processor to construct an automatic visual inspection system.

On the other hand, such as in the case of beer bottles that are recycled by recollection and washing after the contents are drunk and disposed of, which are repeatedly used, the bottle mouth top surface may easily become the subject of scratch or cracks during the use or in transit, so that it is necessary to inspect the top surface of the bottle mouth increasingly severe to the case of new bottles upon the reuse. Also, from such above described inspection, the bottles that are discovered to have abnormalities in the flat smoothness at the top surface of the bottle mouth are rejected from the production line as faulty products.

According to the conventional practices, there was no concept to aggressively polish the top surface of bottle mouth to be a smooth flat plane in the glass bottle production and at the inspection stages after the production, the bad products that lack a smooth flat plane at the top surface of the bottle mouth, were merely rejected as faulty products. Therefore, it was the practice, at the new bottle production stages to enforce sufficient caution to maintain the smooth flatness at the top surface of bottle mouths, while at the recycled bottle processes, the only remedy to maintain such top surface of bottle mouth smooth and flat was by inspection and rejecting the faulty bottles.

In other words, the concept to aggressively polish the bottle mouth top surfaces in order to secure smooth flat planes under the conventional practices did not exist at the new bottle production as well as the reuse by recycled bottles, so that in both cases there was the task of utilization ratio deterioration with further problems from the stand point of resource protection.

OBJECTS AND SUMMERY OF THE PRESENT INVENTION

Accordingly, it is an object of the present invention, in view of the above stated problems, to provide a bottle mouth top surface polishing apparatus which will practically remove such problems as encountered with the prior concepts.

According to an aspect of the present invention, there is provided a bottle mouth top surface polishing apparatus which comprise:

a) rotating means having a rotary shaft;

b) rotary plate means coupled at its center to said rotary shaft;

c) grinding plate means fixed to said rotary plate means, said grinding plate means having a grinding face which is to be made in contact with a bottle mouth top surface to be polished; and d) contact adjusting means for making the contact between said grinding face and said bottle mouth top surface always close over whole contact surfaces thereof upon polishing.

According to another aspect of the present invention, there is provided a bottle mouth top surface polishing apparatus which comprises:

A) a plurality of polishing apparatuses each being formed of rotating means having a rotary shaft, rotary plate means coupled at its center to said rotary shaft, grinding plate means fixed to said rotary plate means, said grinding plate means having a grinding face which is to be made in contact with a bottle mouth top surface to be polished and contact adjusting means for making the contact between said grinding face and said bottle mouth top surface always close over whole contact surfaces thereof upon polishing;

B) means for supporting said plurality of polishing apparatuses;

C) transfer means for transferring a plurality of bottles such that mouth top surfaces of said plurality of bottles are respectively located beneath said grinding faces of said plurality of polishing apparatuses; and D) driving means for driving said plurality of polishing apparatuses.

The above, and other objects, features and advantages of the present invention will become apparent in the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

The present invention will be explained in reference to the drawings hereunder.

Figure 1:
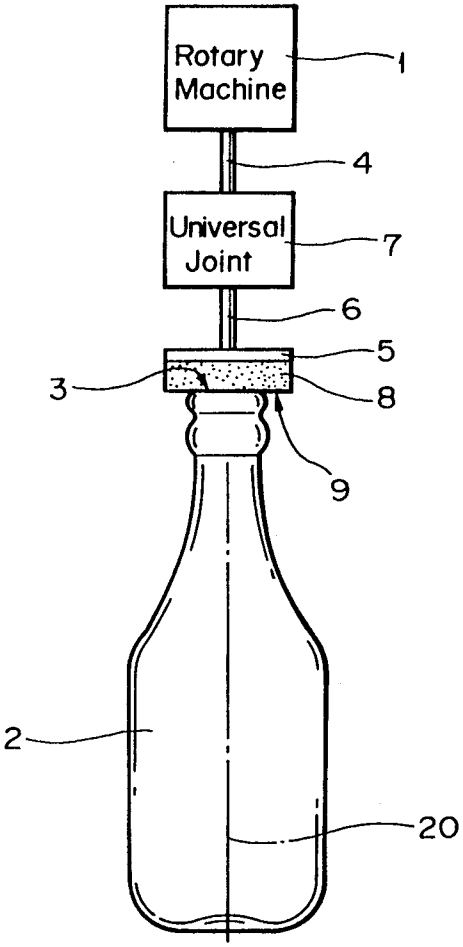
FIG. 1 is a schematic diagram showing a first embodiment of the bottle mouth top surface polishing apparatus according to the present invention.

FIG. 1 shows a schematic drawing of a first embodiment of the bottle mouth top surface polishing apparatus according to the present invention which polishes the top surface of bottle mouth with a grinding plate.

In FIG. 1, 1 is a rotary machine such as a motor, 2 is a bottle of which the top surface 3 is to be polished.

At the example shown in this FIG. 1, a rotation shaft 4 of the motor 1 is connected to rotary shaft 6 of a rotary (circular-shaped) plate 5 through a rotation free conversion means such as a universal joint 7. To the free surface of the rotary plate 5, which is its under surface, a disc-shaped grinding plate 8 is tightly secured. Needless to say, 9 is the polishing surface of the grinding plate 8 and it is with this polishing surface 9 that the top surface 3 of the bottle mouth of bottle 2 is polished.

In the example of FIG. 1, the high speed rotation force of rotating shaft 4 of the rotary machine 1 is transmitted to the rotary shaft 6 via the universal joint 7, by which the rotary plate 5 fixed to the rotating shaft 6 is rotated. Therefore, the disc-shaped grinding plate 8 that is secured on the rotary plate 5 is rotated. Thus, when such grinding surface 9 is pressed onto the top surface 3 at the bottle mouth, the top surface 3 at the bottle mouth is polished to be smoothly flat by the grinding surface 9 of the grinding disc-shaped plate 8 that rotates at high speed.

The motor 1 and the disc-shaped grinding plate 8 are connected through the universal joint 7, which reason is that upon polishing the top surface 3 of the bottle mouth, in order to assure that there is a constant parallel tight contact between the top surface 3 of the bottle mouth and the grinding surface 9 of the grinding plate 8 irregardless of the countering posture thereof.

Figure 2B:
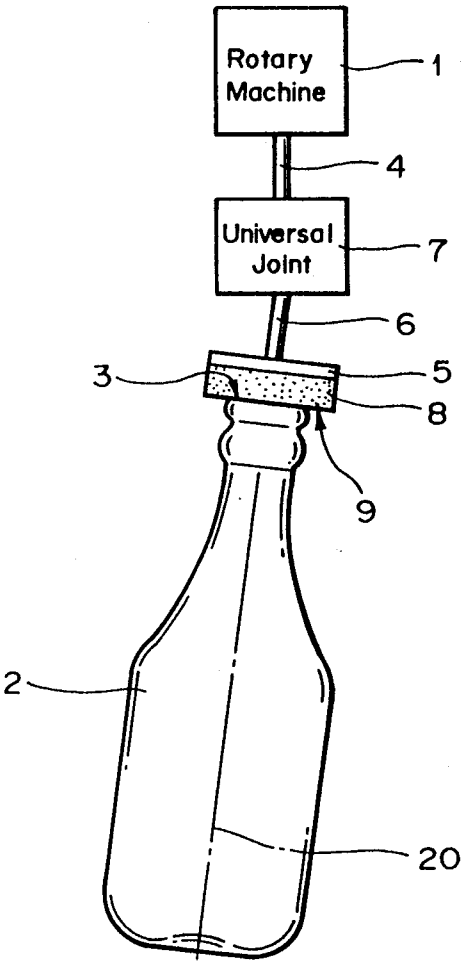
FIGS. 2A and 2B are schematic diagrams that illustrate the same in operation conditions, respectively.
Figure 2A:
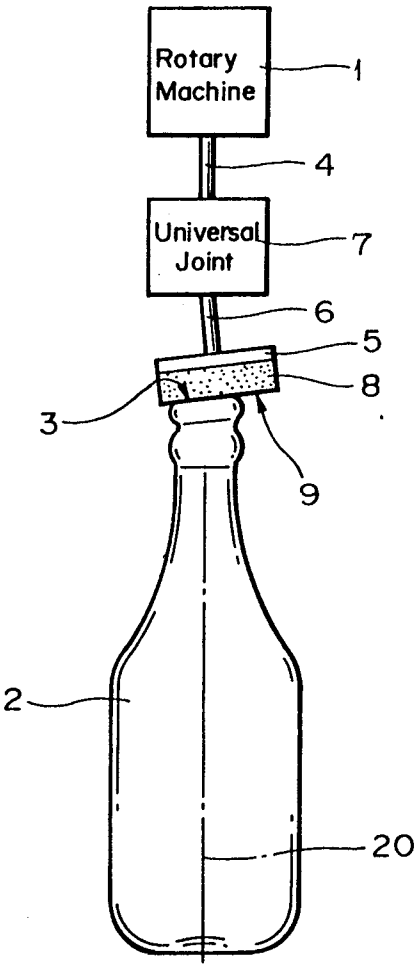

FIG. 2A illustrates the case by a strong exaggeration where the top surface 3 of bottle mouth on bottle 2 is not perpendicular to the center axis 20 of bottle 2 and is tilted, but in such case it is possible to enable contact at a parallel status as shown in FIG. 2A by the function of the universal joint 7 between the top surface 3 of the bottle mouth and the grinding surface 9 of the disc-shaped grinding plate 8 by a relative movement between the grinding plate 8 and bottle 2. In reality, there hardly exists such severe bottle mouth top surface 3 tilt as shown on FIG. 2A, but when the bottle 2 is glass product, it must be recognized that a somewhat tilt of the bottle mouth top surface 3 does exist. However, according to the present invention, it is possible to materialize an accurate contact in parallel to the bottle mouth top surface 3 and the grinding face 9 of the disc-shaped grinder plate 8 by the provision of the universal joint 7.

Further, upon polishing the bottle mouth top surface 3, different to the case of FIG. 2A, although the bottle mouth top surface 3 is not tilted, it can be possible that the center axis 20 of bottle 2 is not parallel to the axis of the grinding surface 9 of the disc-shaped grinder plate 8 (which is rotary shaft 4). Even in such case, upon placing the bottle mouth top surface 3 and the grinding face 9 into contact by the function of the universal joint 7 as shown on FIG. 2B, it is possible that the bottle mouth top surface 3 and the grinding face 9 be in contact by maintaining a parallel condition.

Figure 3:
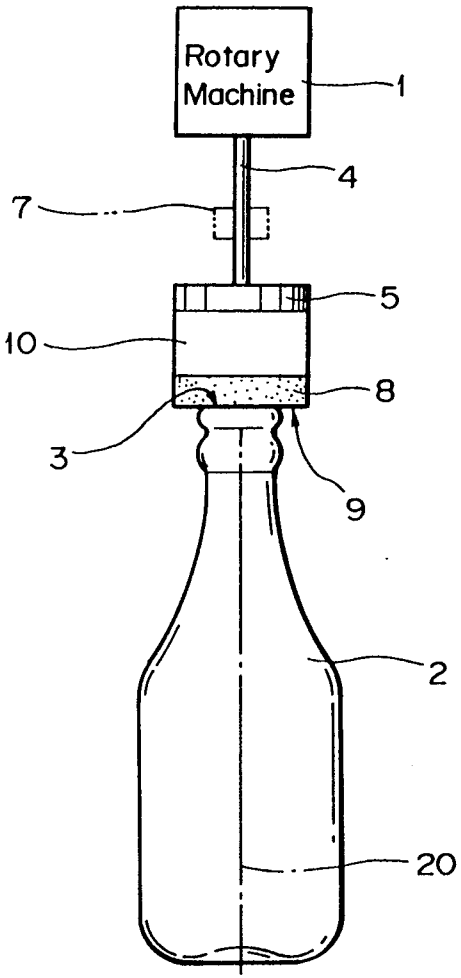
FIG. 3 is a schematic diagram showing a second embodiment of the present invention.

FIG. 3 illustrates a second embodiment of the present invention, in which reference numerals same as those of FIG. 1 designate the same or similar elements and hence their detailed explanation will be omitted.

In the example of FIG. 3, the rotary plate 5 is directly fixed at its center to the rotary shaft 4 of motor 1 and a buffer material 10 such as hard rubber as an example is installed between the rotary plate 5 and the grinding plate 8. By inserting such buffer material 10, the breakage at the bottle mouth top surface 3 by the shock impact of the grinding face 9 of the disc-shaped grinding plate 8 upon contacting the bottle mouth top surface 3, can be prevented.

Figure 4B:
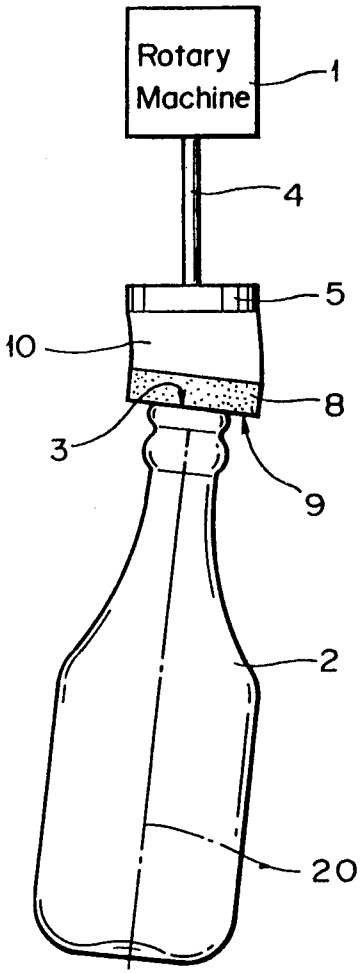
FIGS. 4A and 4B are schematic diagrams that illustrate the second embodiment of the present invention in operation conditions respectively.
Figure 4A:
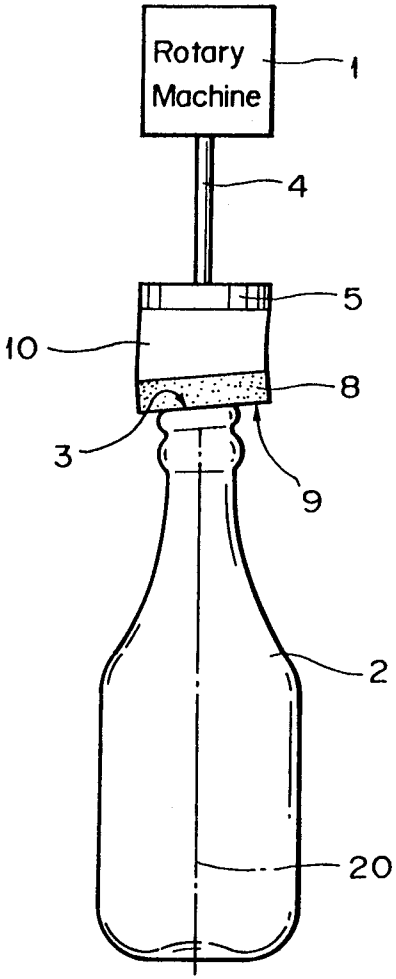

The other effect of installing such buffer material 10 is that when the bottle mouth top surface 3 tilt is to only a small extent as shown on FIG. 4A, even when the universal joint 7 is not provided, when the grinding plate 8 contacts the bottle mouth top surface 3, this buffer material 10 will absorb such tilt so that a good contact will exist between the top surface 3 and grinding face 9.

FIG. 4A illustrates the case by a strong exaggeration where the top surface 3 of bottle mouth on bottle 2 is not perpendicular to the center axis 20 of bottle 2 and is tilted, but in such case it is possible to enable contact at a parallel status as shown in FIG. 4A by the deformation of the buffer material 10 between the top surface 3 of the bottle mouth and the grinding surface 9 of the disc-shaped grinding plate 8. In reality, there hardly exists such severe bottle mouth top surface 3 tilt as shown on FIG. 4A, but when the bottle 2 is glass product, it must be recognized that a somewhat tilt of the bottle mouth top surface 3 does exist. However, according to the second embodiment of the present invention, it is possible to materialize an accurate contact in parallel to the bottle mouth top surface 3 and the grinding face 9 of the disc-shaped grinding plate 8 by the deformation of buffer material 10.

Further, upon polishing the bottle mouth top surface 3, different to the case of FIG. 4A, although the bottle mouth top surface 3 is not tilted, it can be possible that the center axis 20 of bottle 2 is not parallel to the axis of the grinding surface 9 of the disc-shaped grinder plate 8 (which is rotary shaft 4). Even in such case also, upon placing the top surface 3 and the grinding face 9 into contact by the deformation of the buffer material 10 as shown on FIG. 4B, it is possible that the bottle mouth top surface 3 and the grinding face 9 be in contact by maintaining a parallel condition.

If the rotary shaft 4 of motor 1 is divided into two shaft portions and as shown by broken lines in FIG. 3, the two shaft portions divided are coupled through the universal joint 7, even though the parallel relation between the bottle mouth top surface 3 and the grinding face 9 is much more poor as compared with those shown in FIGS. 4A and 4B, the surface 3 and the face 9 can be made in good contact each other by the function of the buffer material 10 and the universal joint 7 upon polishing.

Figure 5A:
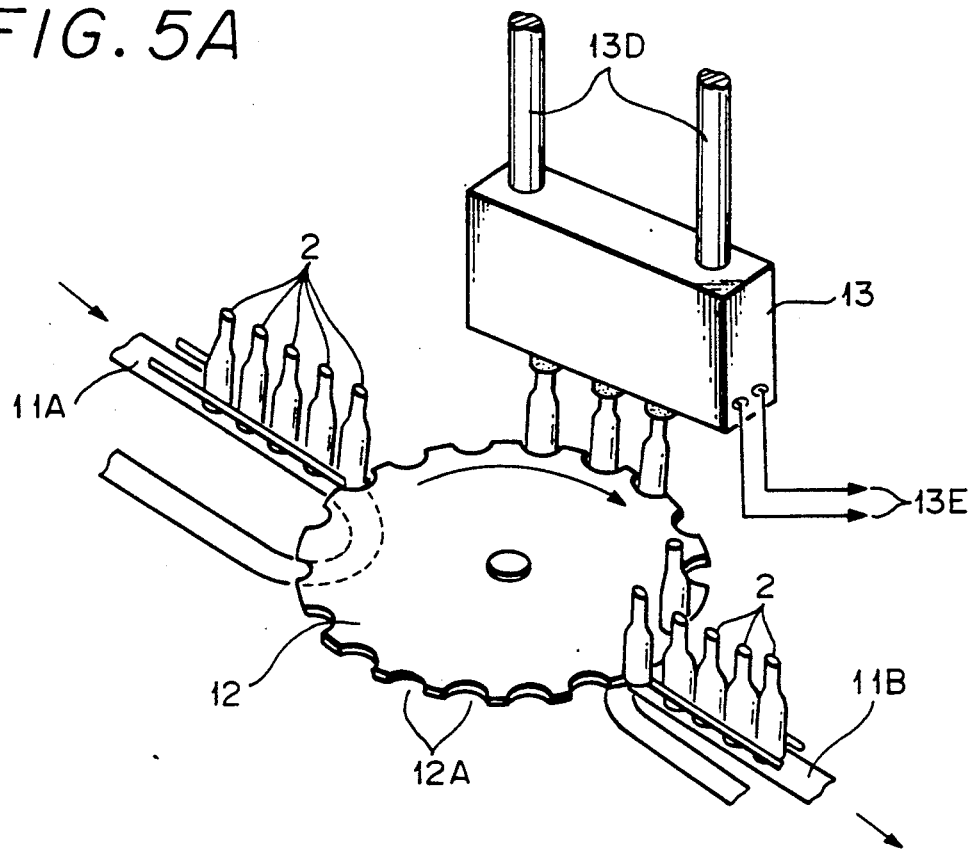
FIGS. 5A and 5B are a perspective view of a third embodiment of the present invention and a partial enlarged side view of the same.
Figure 5B:
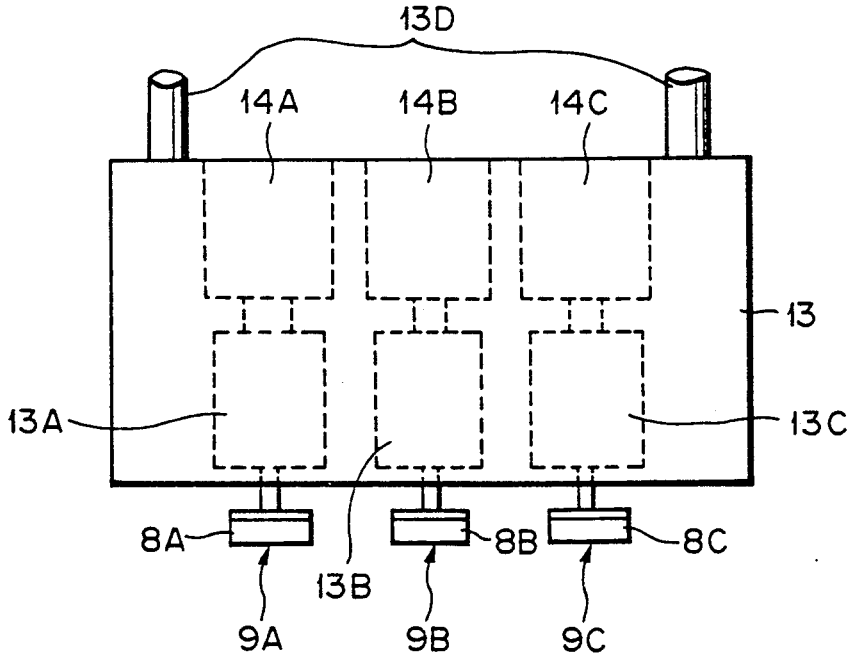

FIGS. 5A and 5B illustrate a perspective view of a third embodiment of the bottle mouth top surface polishing system according to the present invention and a partial enlarged side view thereof. In this example, the bottle mouth top surface 3 is polished for a plural number of times so that the bottle mouth top surface 3 is consecutively ground from coarse grind down to finer grinds.

In FIGS. 5A and 5B, 11A designates a feeding conveyer that transfers a number of the bottles 2 successively, 12 a free rotating starwheel that secures a certain space between the bottles 2 that are fed thereto, 13 a grinding unit that possess, for instance, 3 stages of bottle mouth top surface polishing apparatuses of course, medium and fine grindings.

Starwheel 12 is a disc shape with semi-circular-shaped pockets 12A that intake the bottles 2 at a certain spacing around its peripheral edge, which does not require any special drive power for rotation and can be in a free rotation condition, whereas when the bottles 2 that flow from the conveyer 11A upstream are fit into pockets 12A, the moving force automatically drives the starwheel 12. Although not shown, a semi-circular guide along the outside of the starwheel 12 is installed to prevent droppage of bottles 2 from the pockets 12A. A polishing unit 13 is formed of, for example, three bottle mouth top surface polishing apparatus 13A, 13B and 13C which respectively have different grinding faces 9A, 9B & 9C on the grinding plates 8A, 8B, 8C such as coarse, medium and fine as an example and the spacing between these polishing apparatus 13A, 13B, 13C will be at the same spacing to the pockets 12A on the starwheel 12. In this case, each of the polishing apparatus 13A, 13B and 13C is that shown in, for example, FIG. 1.

Further, since the bottles 2 move in a large semi-circle along with the movement of the pockets 12A on the starwheel 12 to arrive under the polishing apparatus 13A, 13B and 13C, these polishing apparatuses 13A, 13B, 13C must be arranged not in a straight line, but along the same semi-circular arrangement. By this arrangement, when the bottles 2 respectively arrive exactly under the polishing apparatuses 13A, 13B, 13C, the grinding plates 8A,8B and 8C thereof can make press contact onto the bottle mouth top surfaces 3 of bottles 2 so that the bottle mouth top surfaces 3 of the bottles 2 can be accurately polished.

Further, in order to conduct the polishing at the accurate positions whereas the bottles and the grinding plates of the polishing apparatus are on the correct axial relation, although not shown on the drawing, the respective polishing apparatuses 13A, 13B, 13C shall be activated by the signals that indicate the bottle positions from a rotary encoder that is synchronized with the starwheel 12. Otherwise, by the combination of a light transmitter and a light receiver, a bottle position detection senser can be setup at the outside of the apparatus so that the positions of bottles 2 can be detected to set the timing for the polishing. In FIGS. 5A and 5B, 13D designates a supporting means (such as a rod) for the polishing unit 13 by which the polishing unit 13 is instralled at the appropriate positions. 13E in FIG. 5A is the power source wire (later described ) for the respective polishing apparatuses 13A, 13B, 13C etc.

The contents of the polishing unit 13 shall be explained in reference with FIG. 5B. As mentioned above, although the polishing apparatuses 13A, 13B, 13C are respectively equipped with grinding plates 8A, 8B, 8C that respectively have the rough, medium and fine grinding faces 9A, 9B, 9C, all of the other structures are the same one another. The polishing apparatuses 13A, 13B, 13C are respectively coupled to press devices 14A, 14B, 14C which are each formed of an electromagnetic piston as an example, and by which the polishing apparatuses 13A, 13B, 13C are pressed down when the bottles 2 arrive directly under them so that the respective grinding foces 9A, 9B, 9C of the grinding plates 8A, 8B, 8C are pressed into contact with the bottle mouth top surfaces 3 of bottles 2 in order to polish the same. Also, instead of electromagnetic pistons, pneumatic or hydraulic cylinders may be used.

Further, it is preferred that the motors 1 be steadily rotated in order to maintain a constant revolution at the respective grinding plates 8. On the other hand, it is arranged such that the respective press devices 14A, 14B 14C are activated by using position detection signals from the rotary encoders as the control signal. Thus, when the bottles 2 arrive at directly under the respective polishing apparatuses 13A, 13B, 13C, the respective polishing apparatuses 13A, 13B, 13C are pressed down to polish the bottle mouth top surfaces 3.

The power source wirings 13E that are connected to the polishing unit 13 as shown on FIG. 5A are shown by 2 lines for the power line to the motor 1 and the power lines to press devices 14A, 14B, 14C. Also, in FIG. 5A, 11B designates a transfer conveyer for transporting the polished bottles 2 to the storage stage of the like (not shown). Further, the polishing apparatuses 13A, 13B, 13c may be those as shown on FIG. 3.

In the third example of the present invention as shown on FIG. 5, the grinding faces 9A, 9B, 9C of the grinding plates 8A 8B, 8C on the respective polishing apparatuses 13A, 13B, 13C consecutively produce polished surfaces from coarse grinding down to fine finish in this order. In other words, the bottle mouth top surface 3 is as first, coarse-polished by the coarse grinding face 9A of the polishing apparatus 13A, and the same top surface 3 is medium-polished by the finer grinding face 9B of polishing apparatus 13B, which is then finished where the top surface 3 is nextly fine-polished by the fine grinding face 9C of polishing apparatus 13C.

It must be noted that although 3 polishing apparatus were used in the example cited on FIG. 5, the number thereof need not necessarily be 3 sets, whereas it can be 2 sets or rather by the use of 4 or more sets, the polishing can be done at more stages. In such case, it can be arranged so that as the grinding faces of the polishing apparatuses become finer at each step and the motor revolution speed on the polishing apparatus is increased.

It should be understood that the above description is presented by way of example on the preferred embodiments of the invention and it will be apparent that many modifications and variations thereof could be effected by one with ordinary skill in the art without departing from the sprit and scope of the novel concepts of the invention so that the scope of the invention should be determined only by the appended claims.

I claim as my invention:

1. Apparatus for polishing the mouths of bottles comprising a sequence of polishing devices, each having a grinding disk coupled at its center to a rotatable supporting shaft, means for transferring a row of bottles beneath said polishing devices to place each of said bottles successively beneath each of said grinding disks, said sequence of polishing devices having grinding disks of successively decreasing abrasiveness and with drive means for rotating said disks at successively increasing speeds in said sequence.

2. Apparatus for polishing the mouths of bottles comprising a plurality of sequentially arranged polishing devices, each having a grinding disk coupled at its center for conjoint rotation with a supporting shaft; means for adjusting the position of said grinding disk to provide contact with the entire surface of the mouth of the bottle; and means for transferring a row of bottles beneath said polishing devices to place each of said bottles successively beneath each of said grinding disks, said polishing devices having grinding disks of successively decreasing abrasiveness and with drive means for rotating said disks at successively increasing speeds in said sequence progressing from an initial grinding disk to a final grinding disk in the sequence.

3. The apparatus according to claim 2, wherein the means for adjusting the position of the grinding disk comprises a universal joint located midway along said supporting shaft.

4. The apparatus according to claim 2, wherein said grinding disk is mounted on a plate attached to said shaft and said means for adjusting the position of said grinding disk comprises a resilient buffer interposed between said grinding disk and said plate.

5. The apparatus according to claim 2, in which said transfer means comprises a conveyor for moving a plurality of bottles and a starwheel having a number of pockets formed on the outer periphery thereof to receive and transfer said bottles to said polishing apparatuses.

6. The apparatus according to claim 2, including supporting means for supporting said sequence of polishing devices, the drive means for which being mounted on said support means.

* * * * *